US008884745B2

(12) United States Patent
VanDuyn et al.

(10) Patent No.: US 8,884,745 B2
(45) Date of Patent: Nov. 11, 2014

(54) TWIST REMOTE CONTROL WITH KEYBOARD

(75) Inventors: Luke VanDuyn, Highlands Ranch, CO (US); Henry Martch, Parker, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 590 days.

(21) Appl. No.: 12/823,892

(22) Filed: Jun. 25, 2010

(65) Prior Publication Data

US 2011/0260840 A1 Oct. 27, 2011

Related U.S. Application Data

(60) Provisional application No. 61/327,377, filed on Apr. 23, 2010.

(51) Int. Cl.

| | |
|---|---|
| ***G08C 19/16*** | (2006.01) |
| ***G05B 11/01*** | (2006.01) |
| ***H04M 1/00*** | (2006.01) |
| ***G08C 17/00*** | (2006.01) |

(52) U.S. Cl.

CPC ..... *G08C 17/00* (2013.01)
USPC ..... 340/12.5; 340/12.54; 340/12.55; 455/575.1; 455/575.4

(58) Field of Classification Search

USPC ..... 340/825.69
See application file for complete search history.

(56) References Cited

U.S. PATENT DOCUMENTS 5,014,125 A * 5/1991 Pocock et al. ..... 725/93
5,376,970 A * 12/1994 Amano ..... 348/569
6,353,413 B1 * 3/2002 White et al. ..... 342/453
D511,509 S 11/2005 Kim et al.
D515,072 S 2/2006 Lee
D515,544 S 2/2006 Kim et al.

(Continued)

FOREIGN PATENT DOCUMENTS

| | | | |
|---|---|---|---|
| CN | 101646025 | A | 2/2010 |
| DE | 10059981 | | 6/2002 |
| DE | 10059981 | A1 | 6/2002 |

OTHER PUBLICATIONS

Amendment After Allowance Under 37 C.F.R. 1.312 and 14 sheets of replacement formal drawings, dated Nov. 9, 2010, U.S. Appl. No. 29/366,664, 31 pages.

(Continued)

*Primary Examiner* — Brent Swarthout
*Assistant Examiner* — John Mortell
(74) *Attorney, Agent, or Firm* — Seed IP Law Group PLLC

(57) ABSTRACT

A remote control includes a top portion with programming receiver functionality selection members and a bottom portion with a keyboard. The two portions are rotatable between a closed position (where the top portion covers the keyboard) and an open position (where portions of the keyboard project laterally out from under the top portion). When the two portions are in the open position, the selection members and the keyboard share an orientation. The remote control may transmit signals to a programming receiver. The programming receiver may update a display based on signals received from the remote control device. In some implementations, the updated display transmitted by the programming receiver may be based at least in part on a context of a previous display. In various implementations, the remote control may provide indicators to a user. These indicators may be based on signals received from a programming receiver.

18 Claims, 14 Drawing Sheets

(56) References Cited

U.S. PATENT DOCUMENTS

| | | | | |
|---|---|---|---|---|
| D518,475 | S | 4/2006 | Yang et al. | |
| D532,777 | S | 11/2006 | Yu et al. | |
| D538,820 | S | 3/2007 | Andre et al. | |
| D542,758 | S | 5/2007 | Kim et al. | |
| D543,971 | S | 6/2007 | d'Hoore | |
| D549,666 | S | 8/2007 | Tan et al. | |
| D552,086 | S | 10/2007 | Johnson et al. | |
| D552,600 | S | 10/2007 | Oota | |
| D558,714 | S | 1/2008 | Kim et al. | |
| D559,202 | S | 1/2008 | Sim et al. | |
| 7,350,157 | B1 * | 3/2008 | Billmaier et al. | 715/818 |
| 7,383,507 | B2 * | 6/2008 | Shibamiya et al. | 715/721 |
| D584,727 | S | 1/2009 | Liu | |
| D585,052 | S | 1/2009 | Mamane et al. | |
| D614,605 | S | 4/2010 | Teh et al. | |
| D621,372 | S | 8/2010 | Won et al. | |
| D622,703 | S | 8/2010 | Cheng Teh et al. | |
| D628,983 | S | 12/2010 | VanDuyn et al. | |
| D638,825 | S | 5/2011 | Vanduyn et al. | |
| D638,826 | S | 5/2011 | Vanduyn et al. | |
| 2002/0154888 | A1 | 10/2002 | Allen et al. | |
| 2004/0185922 | A1 * | 9/2004 | Sutton et al. | 455/575.1 |
| 2005/0054393 | A1 | 3/2005 | Fagerstrom et al. | |
| 2007/0093281 | A1 | 4/2007 | Park et al. | |
| 2007/0142092 | A1 | 6/2007 | Kim | |
| 2008/0246890 | A1 | 10/2008 | Henty | |
| 2009/0313660 | A1 | 12/2009 | Ni et al. | |
| 2010/0208146 | A1 * | 8/2010 | Reams | 348/734 |

OTHER PUBLICATIONS

International Search Report and Written Opinion dated Mar. 25, 2011, PCT/2011/025200, 12 pages.

* cited by examiner

TWIST REMOTE CONTROL WITH KEYBOARD

RELATED APPLICATIONS

The application claims priority under 35 U.S.C. §119(e) to U.S. Provisional Application Ser. No. 61/327,377, filed Apr. 23, 2010, which is herein incorporated by reference in its entirety.

FIELD OF THE INVENTION

This disclosure relates generally to remote control devices, and more specifically to remote control devices that interact with programming receivers.

SUMMARY

The present disclosure discusses remote control devices and interaction between remote control devices and programming receivers, such as television receivers, set top boxes, digital video recorders, and so on. A remote control device includes a top portion rotatably connected to a bottom portion. The top portion includes a number of selection members associated with programming receiver functionality and the bottom portion includes a keyboard. The two portions are rotatable between a closed position (where the top portion at least partially covers the keyboard) and an open position (where portions of the keyboard are disposed to project laterally out from under the top portion). When the two portions are in the open position, the selection members and the keyboard may share an orientation.

The remote control device may transmit signals to a programming receiver, including signals indicating that the two portions of the remote control device have been rotated to the open and/or closed position. The programming receiver may update a display that the programming receiver transmits to an associated display device based on signals received from the remote control device. In some implementations, the updated display transmitted by the programming receiver may be based at least in part on a context of the previous display that the programming receiver transmitted.

In various implementations, the remote control device may provide indicators to a user such as indicator lights, alert sounds, images displayed on a display incorporated into the remove control device, and so on. These indicators may be based on signals received from a programming receiver.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION OF THE EMBODIMENTS

The description that follows includes sample systems and methods that embody various elements of the present disclosure. However, it should be understood that the described disclosure may be practiced in a variety of forms in addition to those described herein.

Programming receivers, such as television receivers, set top boxes, digital video recorders, and so on, processes programming content for display on associated display devices. The operation of many programming receivers may be directed by users via a remote control device. Such devices may include buttons for turning on and off the programming receiver, selecting channels, ordering and/or viewing on demand programming content, and so on. As the functions supported by programming receivers increase, a full keyboard may be useful to direct the operation of the programming receiver. However, merely adding a full keyboard to a traditional remote control may result in a remote control that is confusing for users, unwieldy, and so on. Further, adding a full keyboard may duplicate buttons already on such a remote control, exacerbating the above mentioned issues.

The present disclosure involves a remote control device and interaction between such a remote control device and a programming receiver. A portion of the remote control device may be rotated to reveal a keyboard. As such, the number of buttons, keys, and so on available to the user may be arranged to avoid user confusion. When revealed, the keyboard may share an orientation with the traditional remote buttons such that the remote control device is not unwieldy for users. Further, the remote control device may transmit signals to a programming receiver when the keyboard is revealed or hidden to accordingly alter a display associated with the programming receiver. Additionally, the remote control device may provide indicators to a user and these indicators may be provided in response to signals received from a programming receiver.

Figure 1:
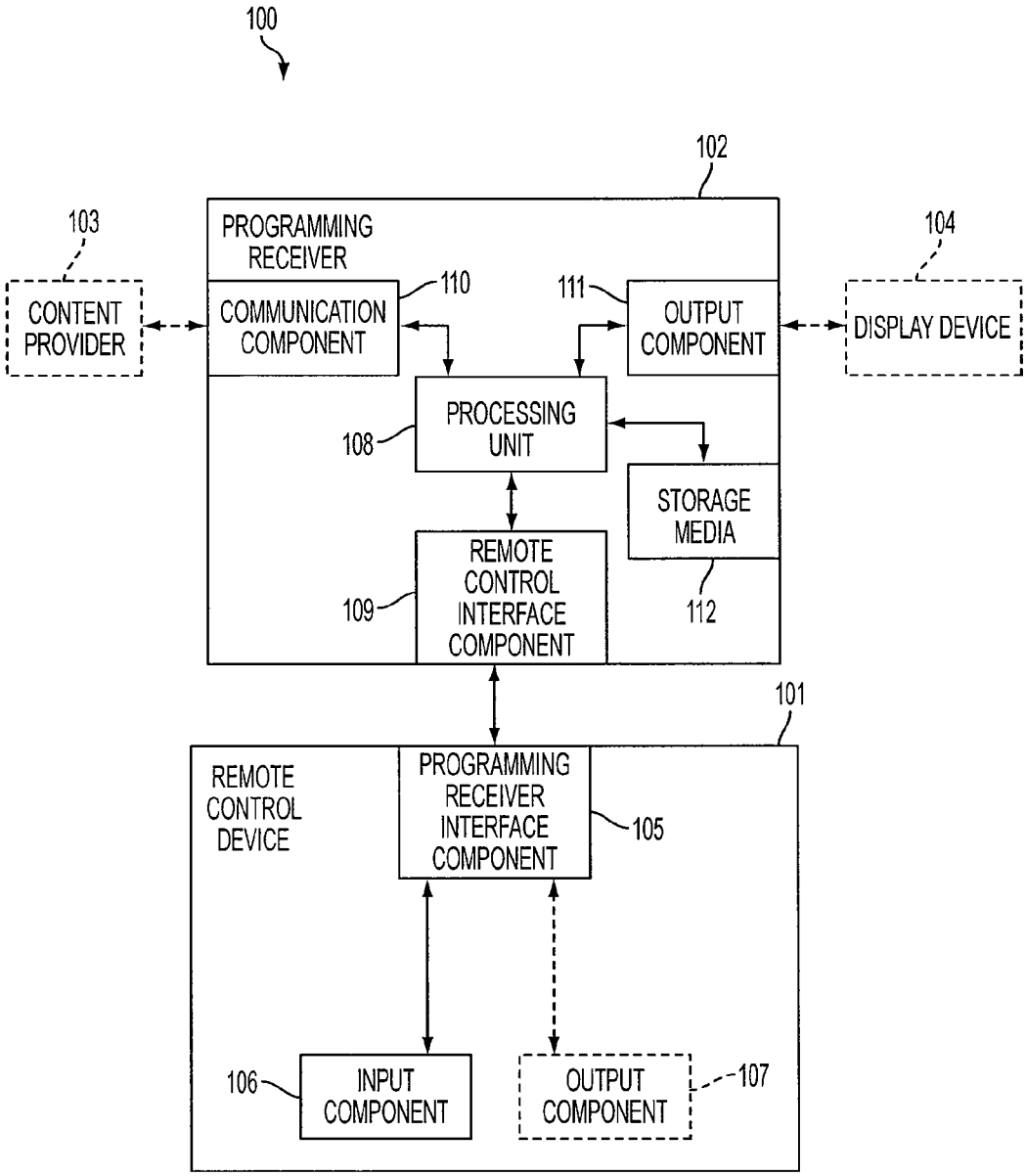
FIG. 1 is a block diagram illustrating a system for interaction between a remote control device and a programming receiver.

FIG. 1 is a block diagram illustrating a system 100 for interaction between a remote control device 101 and a programming receiver 102. The programming receiver may be any device, such a television receiver, a set top box, a digital video recorder, and so on, that processes programming content for display on an associated display device. The remote control device may be operable to transmit signals to the programming receiver that may direct the operation of the programming receiver. The programming receiver may be operable to receive such signals and may also transmit signals to the remote control device. The remote control device may perform operations in response to such signals received from the programming receiver.

The programming receiver 102 may include one or more processing units 108, a remote control interface component 109, a communication component 110, an output component 111, and a storage media 112 (which may be any machine-readable storage media). The one or more processing units 108 execute software instructions stored in the storage medium to perform one or more programming receiver functions. The output component may be wired and/or wirelessly coupled to an output device 104 which may be a display device such as a liquid crystal display, a cathode ray tube display, a television, and so on. The output component may be a port with a hardwired connection to the output device. The communication component may be wired and/or wirelessly coupled to a content provider 103 (such as a cable television provider, a satellite television provider, an Internet provider, and so on) via a communication connection such as a cable connection, satellite connection, Internet connection, and so on. The communication component may receive content (such as programming content, Internet content, and so on) from the content provider. The one or more processing units may store content received by the communication component in the storage media. The one or more processing units may also display content received by the communication component and/or stored in the storage media on the display device utilizing the output component. The remote control interface component may receive one or more signals (such as infrared signals, radio frequency signals, and so on) from the remote control device 101 and the one or more processing units may perform one or more operations in response to receiving such signals. In some implementations, the remote control interface component may transmit one or more signals to the remote control device to direct operation of the remote control device.

The remote control device may include at least an input component 106 and a programming receiver interface component 105. The input component may be wired and/or wirelessly coupled to one or more input devices (not shown) incorporated into the remote control device such as a keyboard, one or more buttons, a keypad, a virtual keyboard, a virtual keypad, a touch screen, a remote control, a mouse, a trackball, a track pad, and so on. The input component may receive input from a user and may transmit signals (such as infrared signals, radio frequency signals, and so on) to the programming receiver 102 via the programming receiver interface component. The remote control device may also receive signals from the programming receiver directing the operation of the remote control device. Such signals may include directions to provide an indicator to a user and the remote control device may include an output component 107 for providing such an indicator. The output component may provide such indicators via one or more output devices (not shown) incorporated into the remote control device such as one or more lights (such as light-emitting diodes, organic light-emitting diodes, incandescent light bulbs, and so on), displays (such as liquid crystal displays, cathode ray tube displays, and so on), speakers, and so on. The input component, programming receiver interface component, and/or output component may include one or more processing units (not shown) that execute instructions stored in one or more tangible media (not shown) in order to process input from input devices, transmit signals to and/or receive signals from the programming receiver, provide output to output devices, and so on.

Figure 2A:
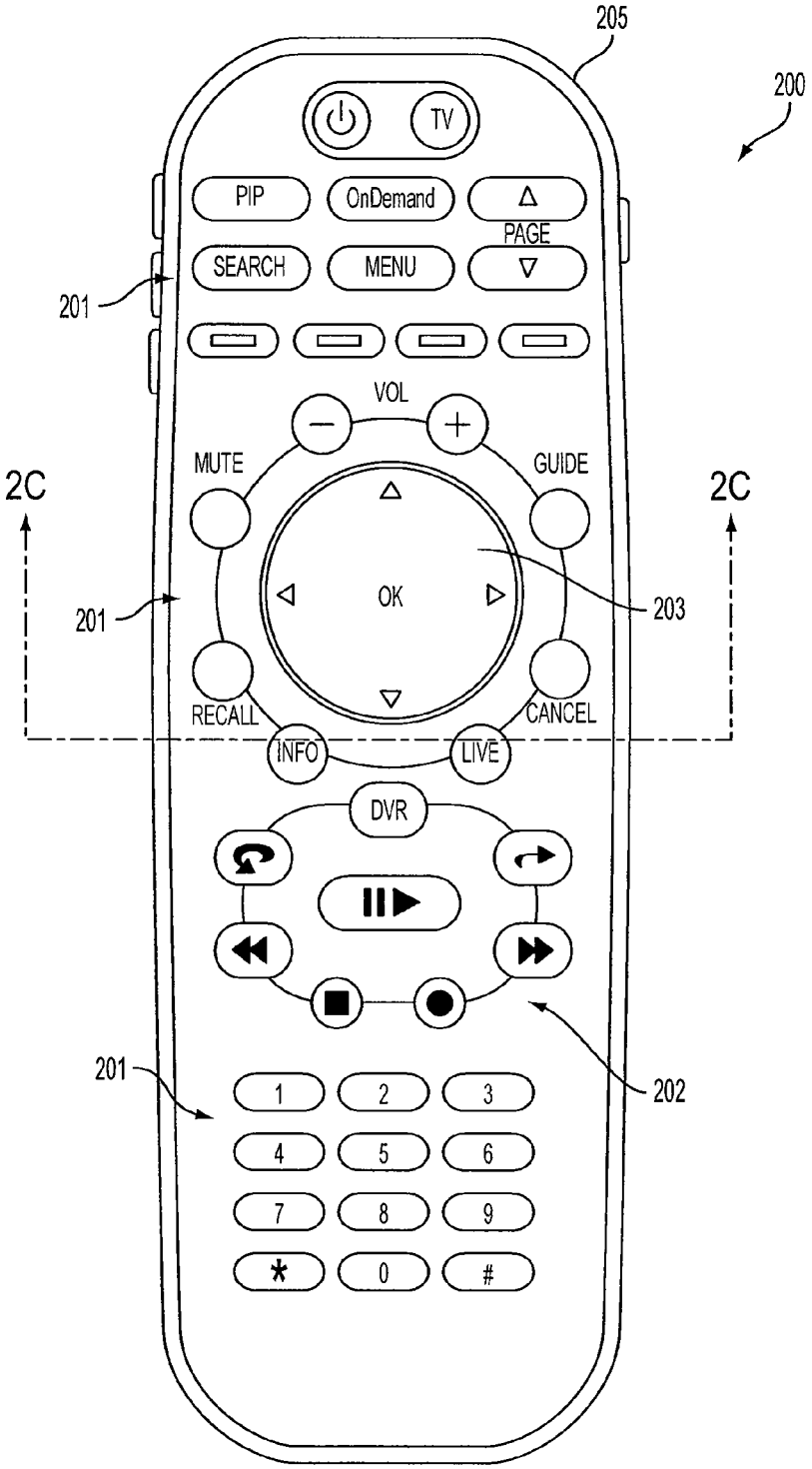
FIGS. 2A and 2B are top plan views illustrating a first example remote control device that may be utilized in the system of FIG. 1.
Figure 2B:
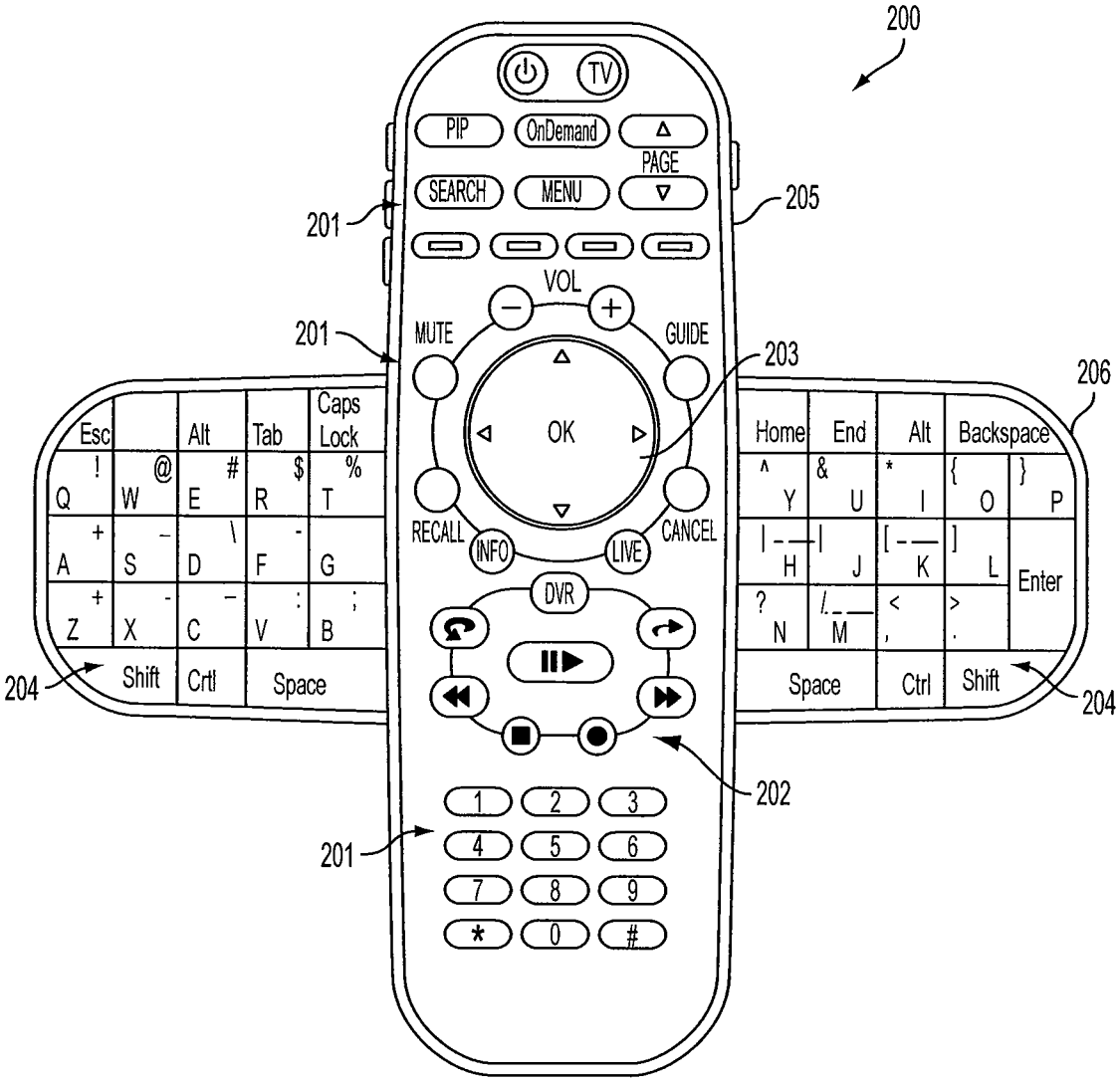

FIGS. 2A and 2B are top plan views of a first example remote control device 200 that may be utilized in the system 100. The main body of the remote control includes a top portion 205 and a bottom portion 206. The top portion and bottom portion are positioned co-extensively with one another, meaning that in an aligned position (shown in FIG. 2A) they appear as one unit. In other words, in the aligned position the top portion essentially covers the bottom portion. The top portion and bottom portion are selectively pivotable relative to one another to change from the aligned position (hereinafter the "closed position") to an extended position (shown in FIG. 2B) (hereinafter the "open position"). In the open position, the bottom portion 206 rotates relative to the top portion 205 to extend laterally at right angles from a middle point along the length of the top portion. However, it is understood that in various other implementations, the bottom portion may extend at other than right angles and from other than the middle point of a longitudinal line without departing from the scope of the present disclosure. Further, t is understood that in various other implementations the top portion and bottom portion may not be positioned entirely co-extensively. In such other implementations, the bottom portion and/or top portion may extend outwardly from the others periphery in any position (open and/or closed) without departing from the scope of the present disclosure.

Figure 2C:
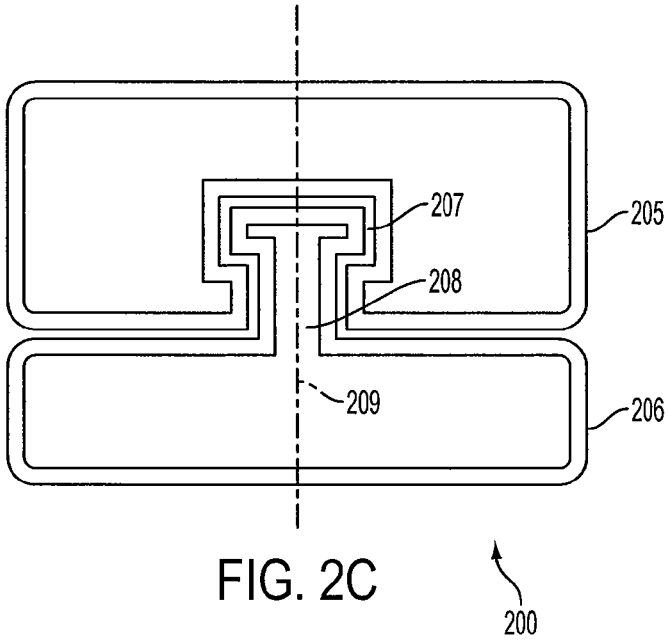
FIG. 2C is a cross-sectional side view of the first example remote control device of FIG. 2A, taken along line 2C-2C in FIG. 2A.
Figure 2D:
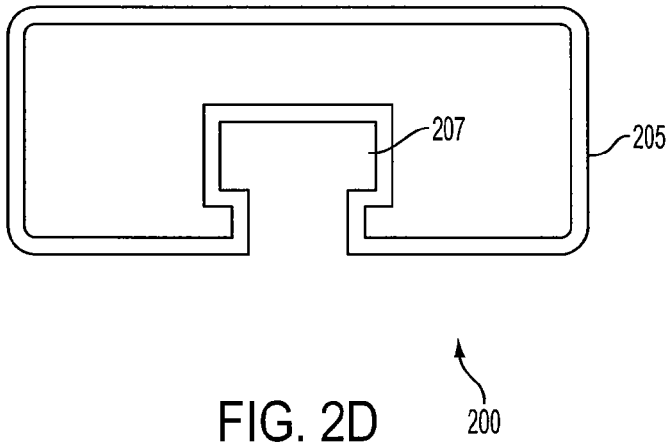
FIG. 2D is a cross-sectional side view of the top portion of the first example remote control device of FIG. 2A, taken along line 2C-2C in FIG. 2A.
Figure 2E:
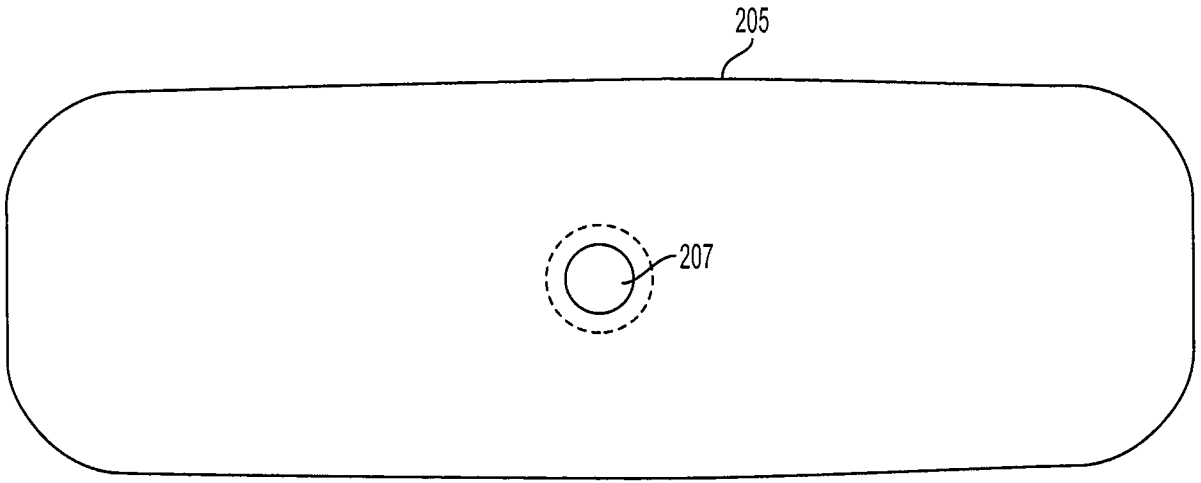
FIG. 2E is a bottom plan view illustrating the top portion of the first example remote control device of FIG. 2A.
Figure 2F:
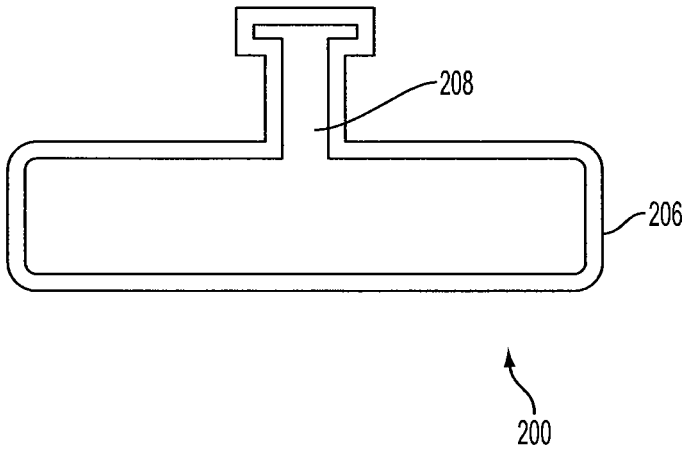
FIG. 2F is a cross-sectional side view of the bottom portion of the first example remote control device of FIG. 2A, taken along line 2C-2C in FIG. 2A.
Figure 2G:
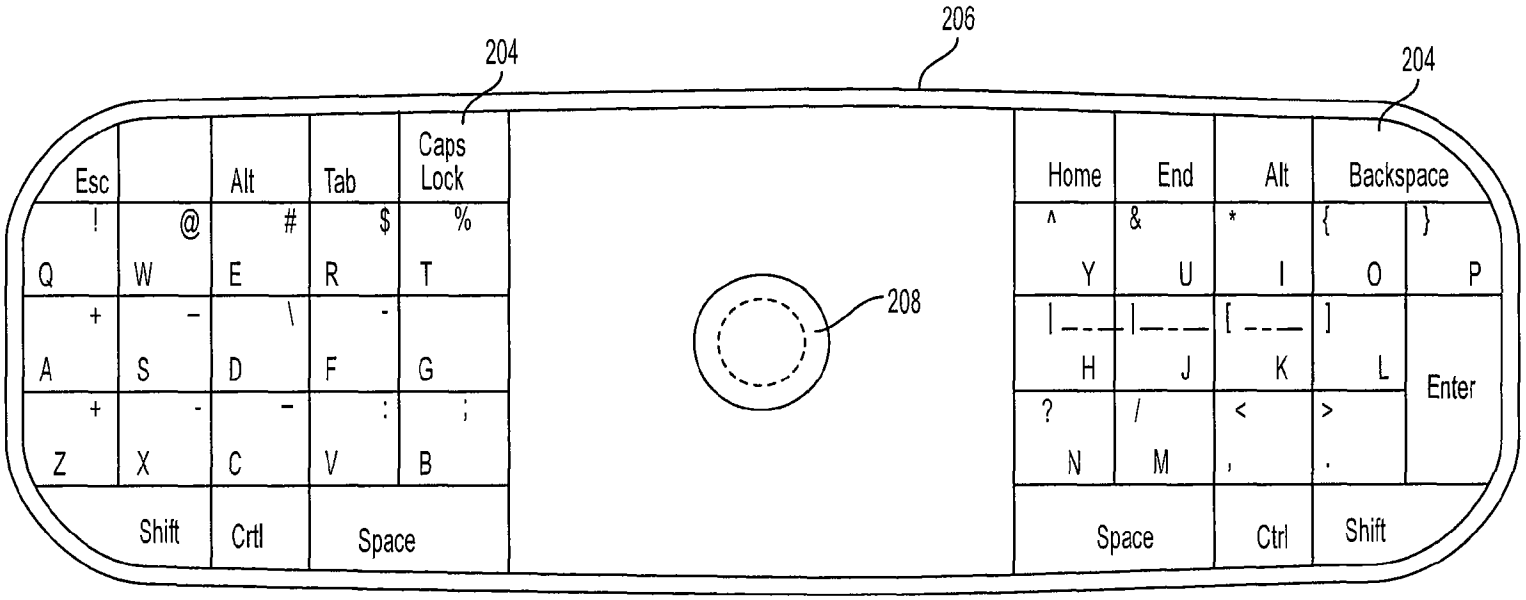
FIG. 2G is a top plan view illustrating the bottom portion of the first example remote control device of FIG. 2A.

The top portion 205 and bottom portion 206 rotate relative to one another around a pivot axis structure. The pivot axis structure allows the top portion and bottom portion to rotate and change orientation, but do not allow the top portion and bottom portion to easily separate. See FIG. 2C. In one implementation, shown in this figure, the pivot axis structure includes a recess 207 in the bottom of the top portion and a protrusion 208 in the top of the bottom portion. The protrusion fits in the recess and allows rotation. As illustrated, a flanged portion of the protrusion received in an annular recessed portion of the recess resists separation. FIG. 2D is a cross-sectional side view of the top portion, taken along line 2C-2C in FIG. 2A. FIG. 2E is a bottom plan view illustrating the top portion. FIG. 2F is a cross-sectional side view of the bottom portion, taken along line 2C-2C in FIG. 2A. FIG. 2G is a top plan view illustrating the bottom portion. Although the pivot axis structure is described as including the protrusion and the recess, the pivot axis structure may take other structural forms without departing from the scope of the present disclosure.

Referring again to FIG. 2C, the pivot axis structure allows relative rotation of the top portion 205 and the bottom portion 206 by rotation of the protrusion 208 along the pivot axis 209 within the recess 207 and/or rotation of the recess around the protrusion along the pivot axis. The protrusion slides within the recess during movement of the protrusion and/or recess along the pivot axis such that the protrusion and recess rotate in opposite directions. When the protrusion rotates in a clockwise direction along the pivot axis within the recess, the bottom portion also rotates clockwise along the pivot axis relative to the top portion. Likewise, when the protrusion rotates in a counterclockwise direction along the pivot axis within the recess, the bottom portion also rotates counterclockwise along the pivot axis relative to the top portion. Similarly, clockwise rotation of the recess around the protrusion along the pivot axis causes the top portion to rotate clockwise along the pivot axis relative to the bottom portion and counterclockwise rotation of the recess around the protrusion along the pivot axis causes the top portion to rotate counterclockwise along the pivot axis relative to the bottom portion.

In some implementations, the pivot access structure may allow full 360 degree relative rotation of the top portion 205 and the bottom portion 206. However, in other implementations, the pivot access structure may include one or more rotation blocking mechanisms (not shown) operable to block relative rotation of the top portion and bottom portion, such as matching systems of detents and/or notches disposed on the protrusion 208 and/or recess 207 and so on. For example, the portions may rotate relative to each other in a particular direction on the pivot axis 209 until one or more detents and/or notches disposed on the protrusion 208 and/or recess 207 engage. Then, the portions may not be able to further rotate relative to each other in that particular direction on the pivot axis. In such implementations the rotation blocking mechanisms may allow 45 degree, 90 degree, 100 degree, 180 degree, and so on relative rotation of the top portion and bottom portion.

In various implementations, the pivot access structure may include one or more locking mechanisms (not shown) for locking the top portion 205 and bottom portion 206 in the open position and/or closed position, such as matching systems of detents and notches disposed on the protrusion 208 and/or recess 207 and so on. When the portions are locked in the open position and/or closed position, the locking mechanisms may resist rotation of the portions until the locking mechanisms are unlocked, such as by application of sufficient force and so on.

Referring again to FIGS. 2A and 2B, the top portion may include a number of selection members 201, 202, and 203 associated with functionality of a programming receiver. These selection members may include programming functionality buttons 201 such as a numeric pad that may be utilized to select channels, buttons to initiate menu screens, buttons to initiate picture in picture screens, power buttons, buttons to initiate on demand content ordering and/or viewing screens, volume modification buttons, and so on. Digital video recorder functionality buttons 202 may also be included in the selection members, such as play buttons, pause buttons, stop buttons, rewind buttons, fast forward buttons, buttons to initiate digital video recorder recording and/or viewing screens, and so on. Further, the selection members may include a touch-based navigational element 203 such as a touchpad, touch screen, and so on. The navigational element may be utilized to direct a navigational indicator displayed on a display device by a programming receiver such as a cursor, mouse pointer, and so on. Additionally, the navigational element may be utilized as a directional navigation pad such that the respective edges of the touchpad may be pressed to indicate a direction and/or the center of the touchpad may be pressed to indicate a selection.

As illustrated in FIG. 2B, the bottom portion may include a keyboard 204 with a number of keys. Although the keyboard is shown with keys arranged in a QWERTY keyboard layout, it is understood that other arrangements (such as a QWERTZ keyboard layout, an AZERTY keyboard layout, a QZERTY keyboard layout, a Dvorak simplified keyboard layout, a Neo keyboard layout, a Turkish keyboard layout, and so on) are possible without departing from the scope of the present disclosure. As portions of the keyboard are disposed to project laterally out from under multiple sides the top portion of the remote control device 200 when the portions are in the open position, users of the remote control device may not experience as many handedness issues as they would if the keyboard was disposed to project out from only one side of the top portion. Right handed users may experience difficulty typing on a keyboard of a remote control projecting only from a left side just as left handed users may experience difficulty typing on a keyboard of a remote control projecting only from a right side. By disposing the keyboard on both sides of the remote control device 200, both right handed and left handed users may be accommodated.

As shown, the selection members 201, 202, and 203 and the keys of the keyboard 204 share an orientation (i.e., are oriented to face substantially the same direction) when the top portion and the bottom portion are in the open position. Thus, in the open position the remote control device 200 may be held by a user utilizing one or more hands while the user operates one or more of the selection members, one or more of the keys, or one or more of both without the user having to alter the orientation of the remote control device. This enables a user to perform operations with the remote control device that utilize both the selection members and the keys without having to repeatedly alter the orientation of the remote control device, reducing potential confusion for the user.

In various implementations, the selection members 201, 202, and 203 and the keys of the keyboard 204 may each be associated with different functionality. As such, the total number of selection members and/or keys may be kept to a minimum by preventing duplication of functions between the selection members and keys. Further, in various implementations one or more of the selection members may be assigned to different functionality when the top portion and bottom portion are in the closed position than when the portions are in the open position. For example, a selection member may be associated with programming functionality when the portions are in the closed position but may be altered to be associated with Internet hotkey functionality (such as a home function, stop function, Internet search function, refresh function, and so on) when the portions are in the open position.

Referring again to FIGS. 2A and 2B, the remote control device 200 may be operable to send signals to a programming receiver when one or more of the selection members 201, 202, and 203 and/or one or more keys of the keyboard 204 are activated. The signals may indicate which of the selection members and/or keys have been activated. Further, the remote control device may be operable to send signals to the programming receiver when one or more of the selection members 201, 202, and 203 and/or one or more keys of the keyboard 204 are activated. The signals may indicate which of the selection members and/or keys have been activated. Further, the remote control device may be operable to send signals to the programming receiver indicating that the top portion and bottom portion have rotated into the open position and/or closed position.

Referring again to FIG. 1, the programming receiver may transmit a display to the display device 104 via the output component 111. The display may include content (such as programming content, Internet content, and so on) received via the communication component 110, stored on the storage media 112, and so on. The display may also include one or more menus, interfaces, and so on (such as a channel selection menu, an electronic programming guide, an on-demand video menu, a digital video recorder menu, and so on). The programming receiver may receive signals transmitted by the remote control device 200. In response, the programming receiver may perform one or more operations based on the received signals. Such operations may include transmitting an updated display to the display device based on the received signals.

By way of a first example, the programming receiver 102 may transmit a display that includes programming content associated with a first programming channel. The programming receiver may then receive a signal from the remote control device 200 indicating to change the channel for which programming content is displayed. In response to the received signal, the programming receiver may transmit an updated display that includes programming content associated with the changed channel.

In a second example, the programming receiver 102 may transmit a display that includes an electronic channel guide. The electronic programming guide may include information regarding available programming content such as one or more channels associated with the programming content, one or more programming content titles, one or more descriptions of the programming content, and so on. The programming receiver may then receive a signal from the remote control device 200 indicating to display programming content associated with information displayed in the electronic programming guide. In response to the received signal, the programming receiver may transmit an updated display that includes the indicated programming content.

In a third example, the programming receiver 102 may transmit a display that includes programming content. The programming receiver may then receive a signal from the remote control device 200 indicating that the top portion and bottom portion of the remote control device have been rotated to the open position. In response to the received signal, the programming receiver may transmit an updated display that includes an Internet browser. In some implementations of this example, both the Internet browser and the programming content may constitute portions of the updated display, similar to a split screen or picture in picture display. In other implementations of this example, the updated display may include the Internet browser and not the programming content. Subsequently, the programming receiver may receive a signal from the remote control device 200 indicating that the portions of the remote control device have been rotated to the closed position. In response, the programming receiver may transmit another updated display that does not include the Internet browser.

The updated display that the programming receiver 102 transmits based on received signals may be at least partially based on a context of the display transmitted by the programming receiver. Further, in such cases the programming receiver may transmit a particular updated display in response to a received signal if the context of the previously transmitted display is a particular context and a different updated display if the context of the previously transmitted display is a different context. In some implementations of these cases, the above referenced particular context may be a default context (such as displaying programming content and so on) and the above referenced different context may be a menu context (such as an electronic programming guide menu, an on demand programming content menu, a digital video recorder menu, and so on).

By way of a fourth example, if the display transmitted by the programming receiver includes programming content and the programming receiver receives a signal indicating that the top and bottom portions of the remote control device 200 have been rotated to the open position, the programming receiver may transmit an updated display including an Internet browser. The updated display may include the Internet browser at least partially based on the fact that the previously transmitted display included programming content. However, in this example, if the display transmitted by the programming receiver includes an electronic programming guide that is navigable by scrolling and the programming receiver receives a signal indicating that the portions of the remote control device have been rotated to the open position, the programming receiver may transmit an updated display including a text entry user interface (such as a cursor, a text box, and so on). The text entry user interface may be utilized to perform one or more text-based searches to navigate the electronic programming guide. The keys of the keyboard 204 of the remote control device may be utilized to enter text characters for the text-based searches.

Referring again to FIGS. 2A and 2B, the remote control device 200 may provide one or more indications to a user. The indications may be provided to the user in response to a signal received from a programming receiver. The remote control device may provide such indications via output devices such as lights (including light-emitting diodes, organic light-emitting diodes, incandescent light bulbs, and so on), displays (such as liquid crystal displays, cathode ray tube displays, and so on), speakers, and so on.

By way of a fifth example, a programming receiver may transmit a signal to the remote control device 200 when the programming receiver is expecting input related to the keyboard 204, such as when the programming receiver transmits a display including an Internet browser, a text entry field, and so on. In response to receiving the signal, in some implementations the remote control device may illuminate one or more light-emitting diodes disposed within the keyboard, essentially illuminating the keyboard. The illumination of the keyboard may thus indicate to the user that the keyboard may currently be utilized to provide input to the programming receiver. In other implementations, the remote control device may respond to such a signal by providing a sound alert (such as a buzz, bell, and so on) via a speaker device.

By way of a sixth example, a programming receiver may have received signals from the remote control device 200 corresponding to one or more characters of a text-based search of an electronic program guide. The programming receiver may analyze the text present in the electronic program guide to find text that the user may be searching for based on the one or more characters. The programming receiver may then transmit signals that cause the remote control device to illuminate keys associated with possible next characters. This may aid users performing text-based searches by helping the user spell difficult words, indicating that words they may be searching for are not present if the next character is not illuminated, and so on.

In a seventh example, the programming receiver may perform operations to implement a text messaging application. In this example, in response to one or more signals received from a programming receiver, the remote control device 200 may display a text messaging interface on a display device (such as a liquid crystal display, cathode ray tube display, and so on) incorporated into the remote control device. In various implementations of this example, the remote control device may update the text messaging interface on the display device incorporated into the remote control device based on user input and/or additional signals from the remote control device. Further, the remote control device may transmit user input to the programming receiver for further transmission related to the text messaging application implemented by the programming receiver.

By way of an eighth example, the programming receiver may transmit a display including an Internet browser. The programming receiver also may associate one or more of the selection members 201, 202, and 203 with one or more Internet functions. As such, the programming receiver may transmit one or more signals causing the remote control device 200 to illuminate the one or more selection members to indicate to a user that the selection members are associated with currently available Internet functions.

Figure 3:
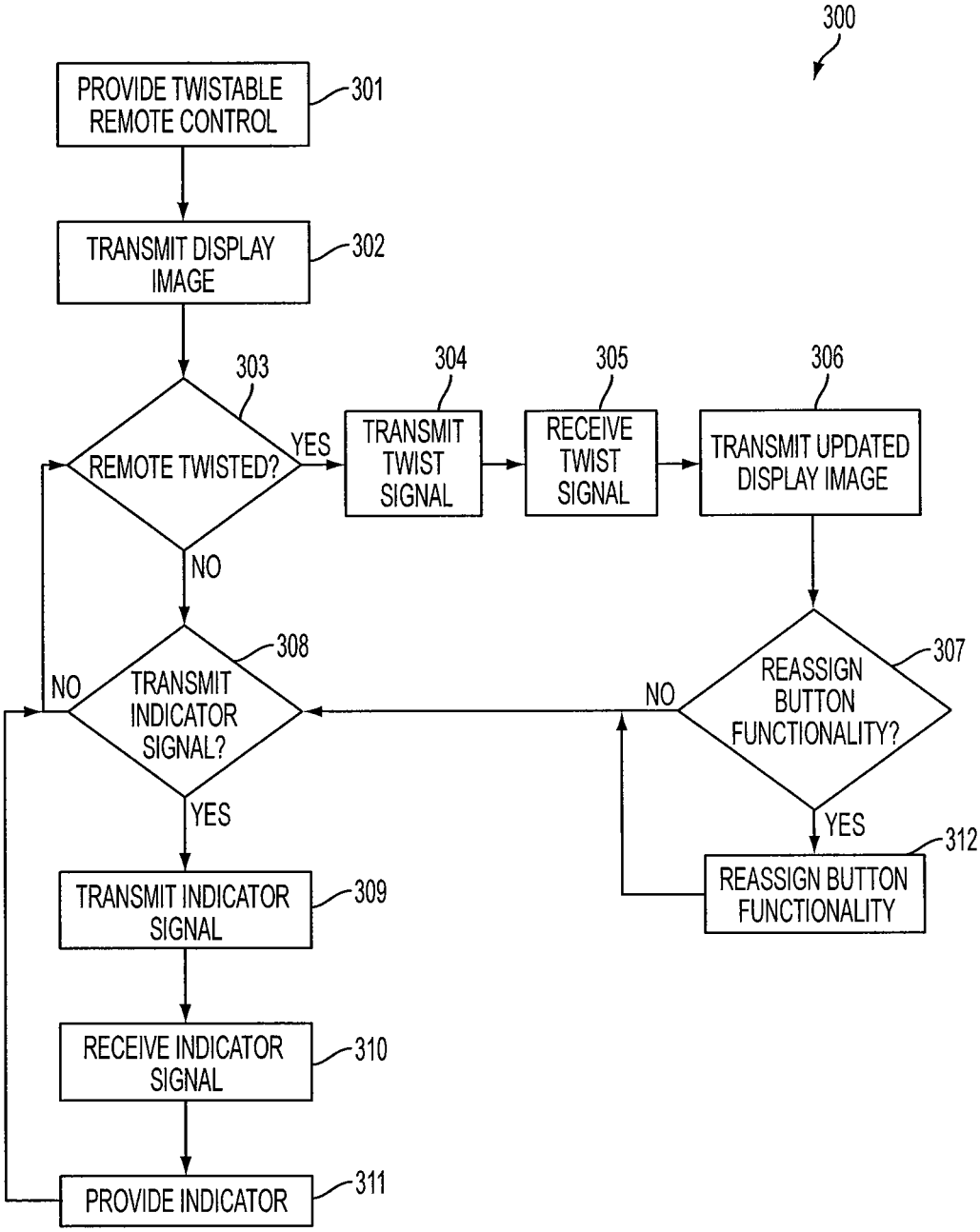
FIG. 3 is a flow chart illustrating a method of interaction between a remote control device and a programming receiver that may be performed by the system of FIG. 1.

FIG. 3 illustrates a method 300 of interaction between a remote control and a programming receiver which may be performed by the system 100. The system 100 may utilize the remote control device 200 in performing the method 300. The flow begins at block 301 where the remote control device 200 is provided. The flow then proceeds to block 302 where the programming receiver 102 transmits a display image. Subsequently, the flow proceeds to block 303.

At block 303, the remote control device 200 determines whether the remote control device has been rotated to the open or closed position. If the remote control device has been rotated to the open or closed position, the flow proceeds to block 304. If the remote control device has not been rotated to the open or closed position, the flow proceeds to block 308.

At block 304, the remote control device 200 transmits a signal indicating the position to which the remote control device has been rotated. The flow then proceeds to block 305. At block 305, the programming receiver 102 receives the transmitted signal and the flow proceeds to block 306. At block 306, the programming receiver transmits an updated display image based on the received signal. The updated display image that the programming receiver transmits may be based on a context of the previously transmitted display image. The flow then proceeds to block 307.

At block 307, the programming receiver 102 determines whether to reassign functionality of one or more of the selection members 201, 202, and 203 based on the received signal. If the programming receiver determines to reassign functionality of the one or more of the selection members, the flow proceeds to block 312. If the programming receiver determines not to reassign functionality of the one or more of the selection members, the flow proceeds to block 308.

At block 308, the programming receiver 102 determines whether to transmit an indicator signal specifying for the remote control device 200 to provide an indicator. If the programming receiver determines to transmit an indicator signal specifying for the remote control device 200 to provide an indicator, the flow proceeds to block 309. If the programming receiver determines not to transmit an indicator signal specifying for the remote control device 200 to provide an indicator, the flow proceeds to block 303.

At block 309, the programming receiver 102 transmits an indicator signal specifying for the remote control device 200 to provide an indicator. The flow then proceeds to block 310. At block 310, the remote control device 200 receives the transmitted indicator signal and the flow proceeds to block 311. At block 311, the remote control device provides the indicator based on the indicator control signal and the flow proceeds to block 311.

Although the method 300 is illustrated as including blocks 301 through 312, it is understood that other operations may be performed along with the illustrated operations without departing from the scope of the present disclosure. By way of one example, the programming receiver 102 may transmit updated display images based on signals received from the remote control device 200 indicating that one or more of the selection members 201, 202, and 203 have been selected in addition to transmitting updated display images based on signals indicating that the remote control device has been rotated to the open or closed position.

Figure 4A:
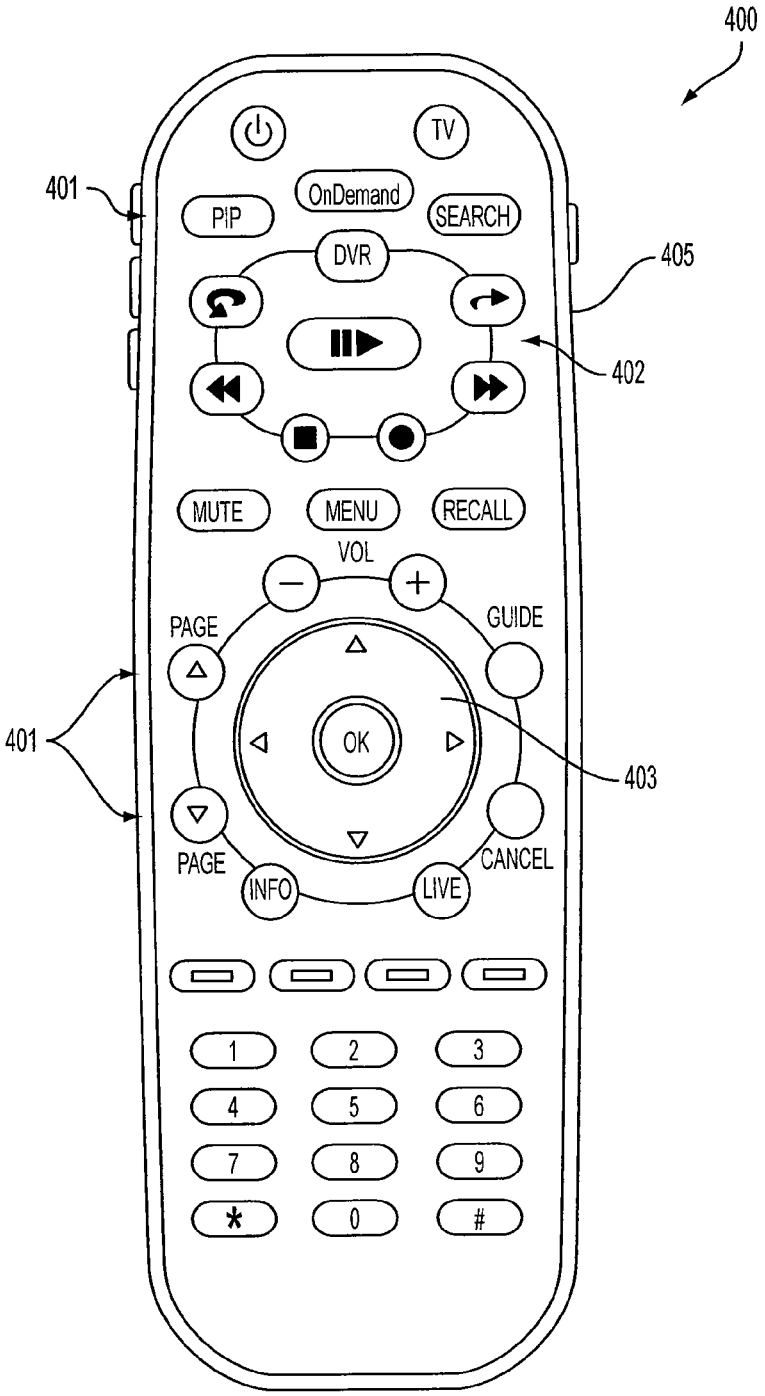
FIGS. 4A and 4B are top plan views illustrating a second example remote control device that may be utilized in the system of FIG. 1.
Figure 4B:
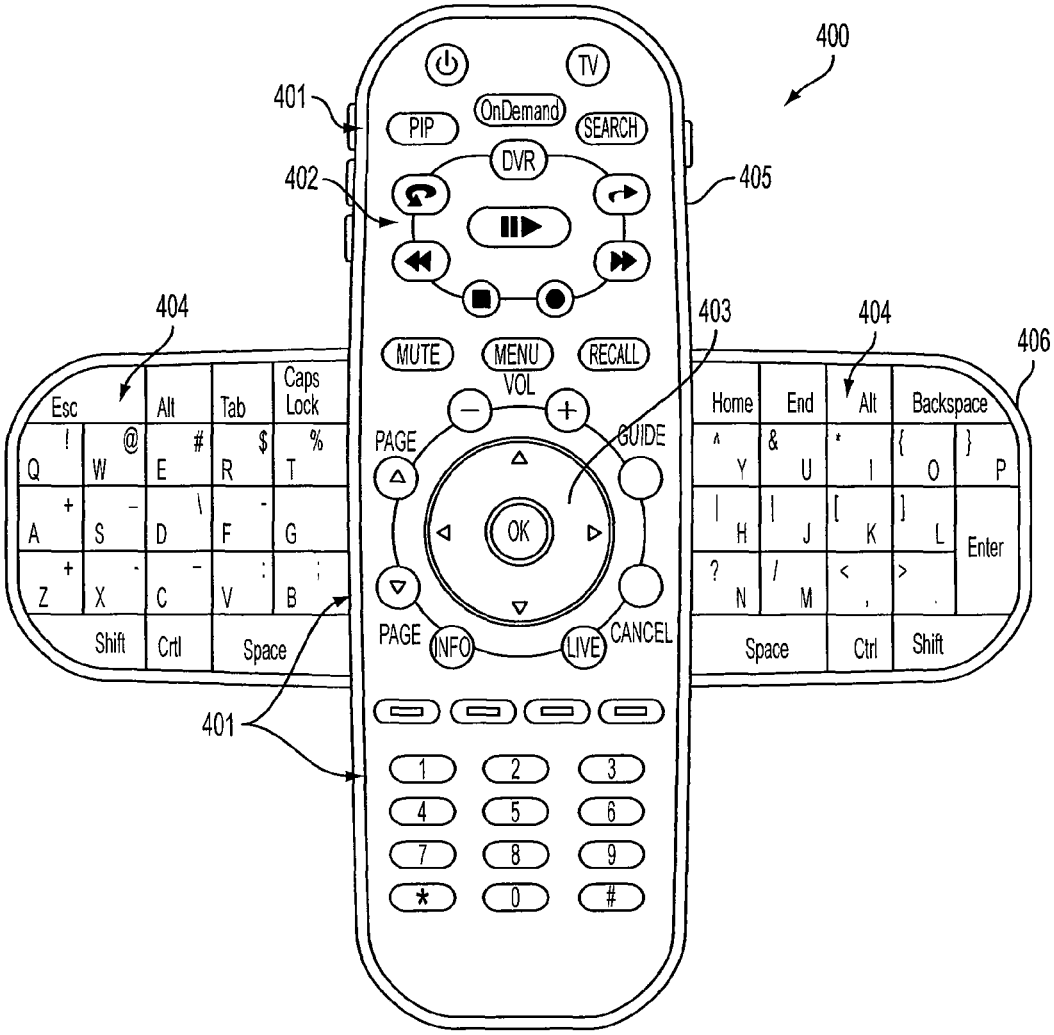

FIGS. 4A and 4B are top plan views illustrating a second example remote control device 400 that may be utilized in the system 100. As can be seen by comparison of FIGS. 4A and 4B with FIGS. 2A and 2B, the selection members 401, 402, and 403 of the remote control device 400 are arranged in a different configuration than the selection members 201, 202, and 203 of the remote control device 200.

Figure 5A:
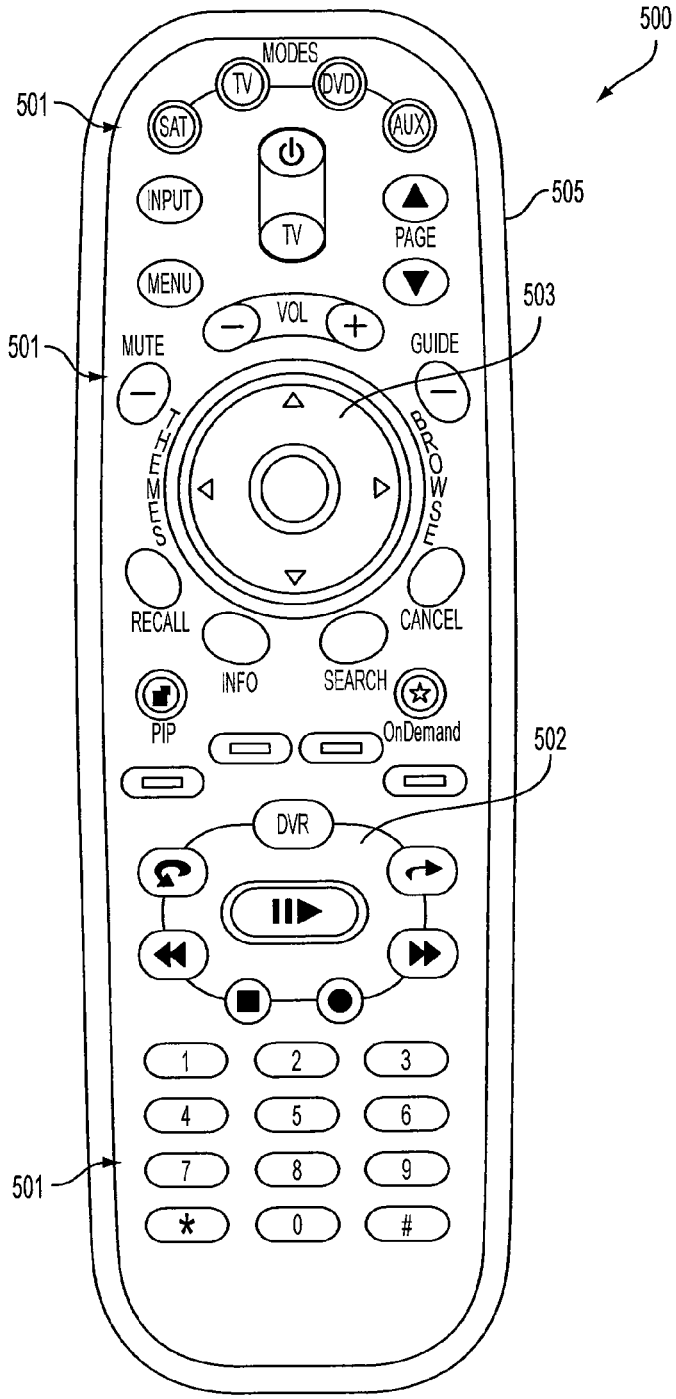
FIGS. 5A and 5B are top plan views illustrating a third example remote control device that may be utilized in the system of FIG. 1.
Figure 5B:
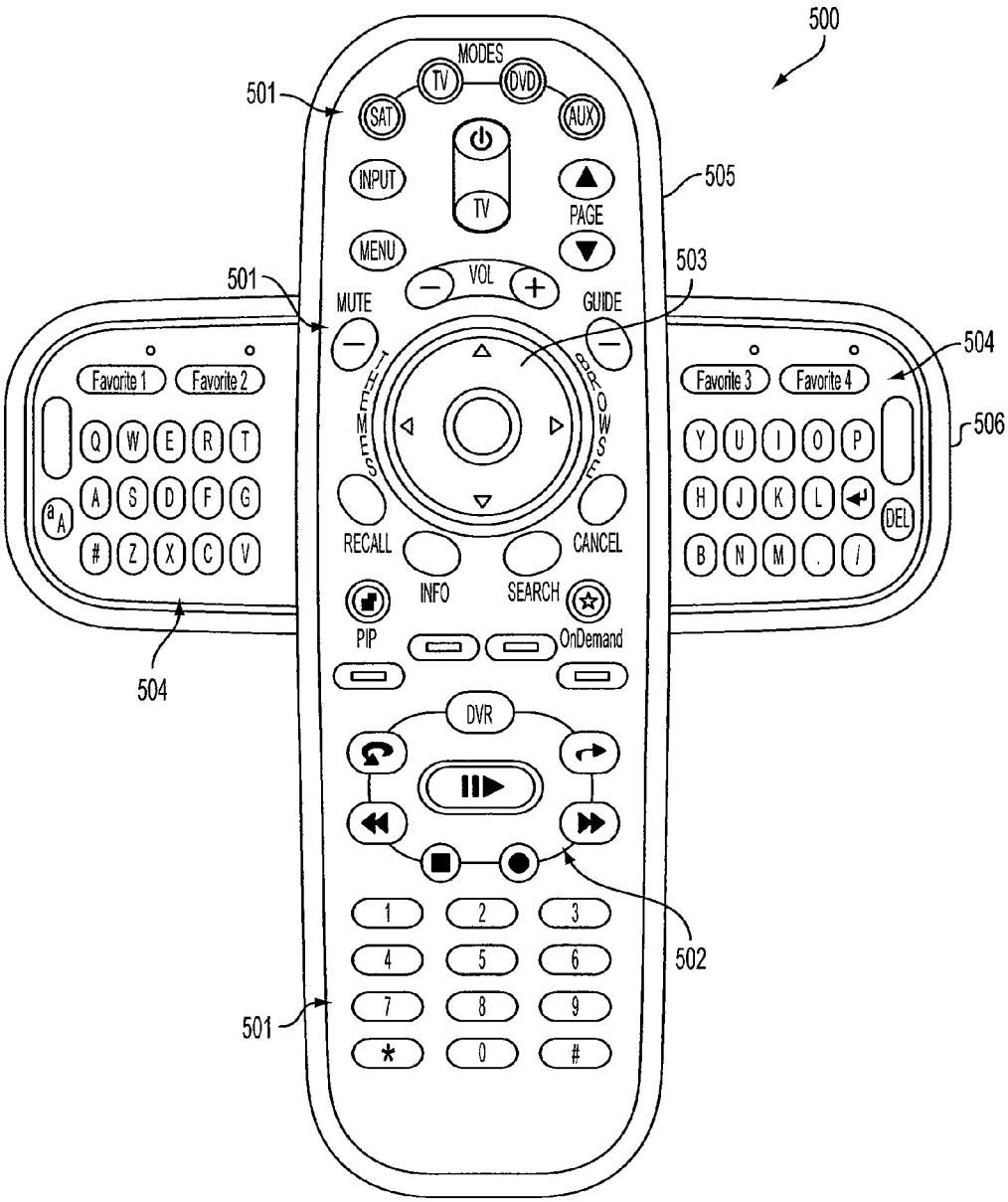

FIGS. 5A and 5B are top plan views illustrating a third example remote control device 500 that may be utilized in the system 100. The remote control device 500 may include an optical navigational element 503 that may utilize light-emitting diodes and/or photodiodes to detect movement over the optical navigational element. The optical navigational element may be utilized to direct a navigational indicator displayed on a display device by a programming receiver (such as a cursor, mouse pointer, and so on). Additionally, the optical navigational element may be utilized as a directional navigation pad such that movement hovering over respective edges of the touchpad may indicate a direction and/or the movement hovering over the center of the touchpad may indicate a selection.

As can be seen by comparison of FIGS. 5A and 5B with FIGS. 2A and 2B, the selection members 501, 502, and 503 of the remote control device 500 are arranged in a different configuration than the selection members 201, 202, and 203 of the remote control device 200. Additionally, the remote control device 500 includes optical navigational element 503 as compared to the touch-based navigational element 203 of the remote control device 200. Further, as can be seen by comparison of FIG. 5B with FIG. 2B, the keyboard 504 of the remote control device 500 is arranged in a different configuration than the keyboard 204 of the remote control device 200. Moreover, in an open position, the bottom portion 506 of the remote control device 500 extends laterally at right angles from an off-center point along the length of the top portion 505 rather than extending laterally at right angles from a middle point like bottom portion 206 and top portion 205 of the remote control device 200 do in the open position. Furthermore, the bottom portion 506 has a narrower length than the top portion 505, unlike the relatively equivalent length of bottom portion 206 and top portion 205 of the remote control device 200.

Figure 6A:
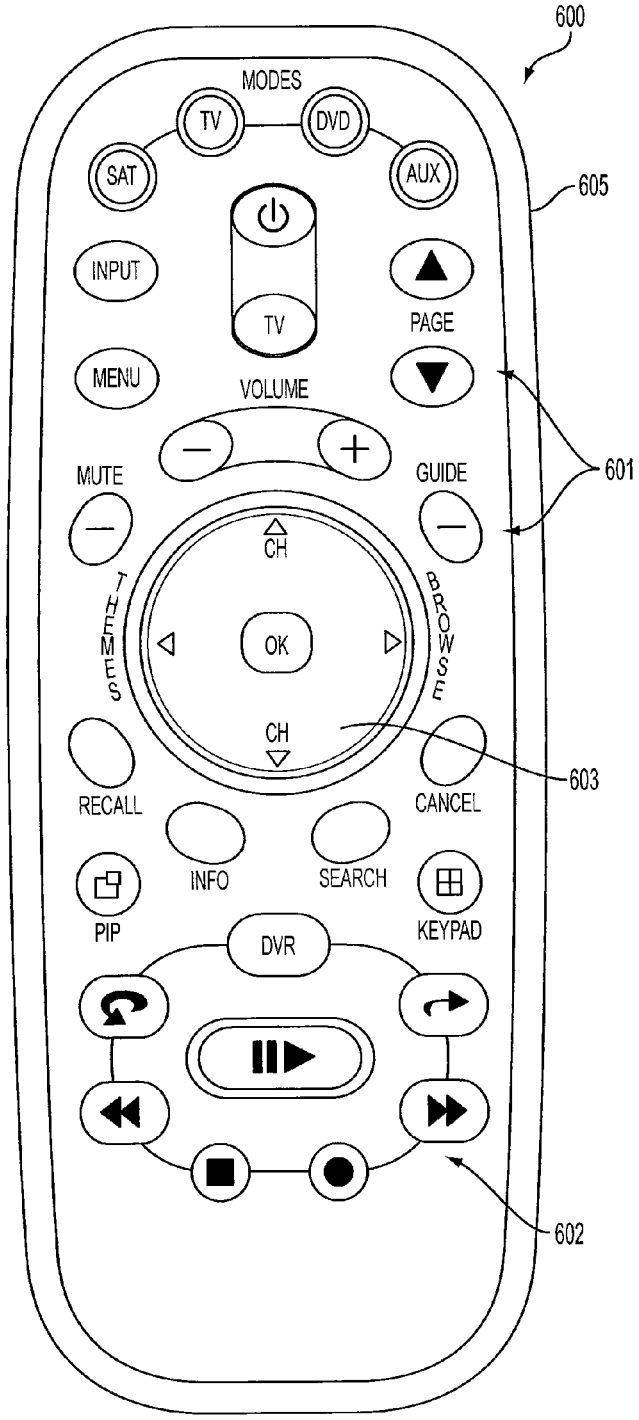
FIGS. 6A and 6B are top plan views illustrating a fourth example remote control device that may be utilized in the system of FIG. 1.
Figure 6B:
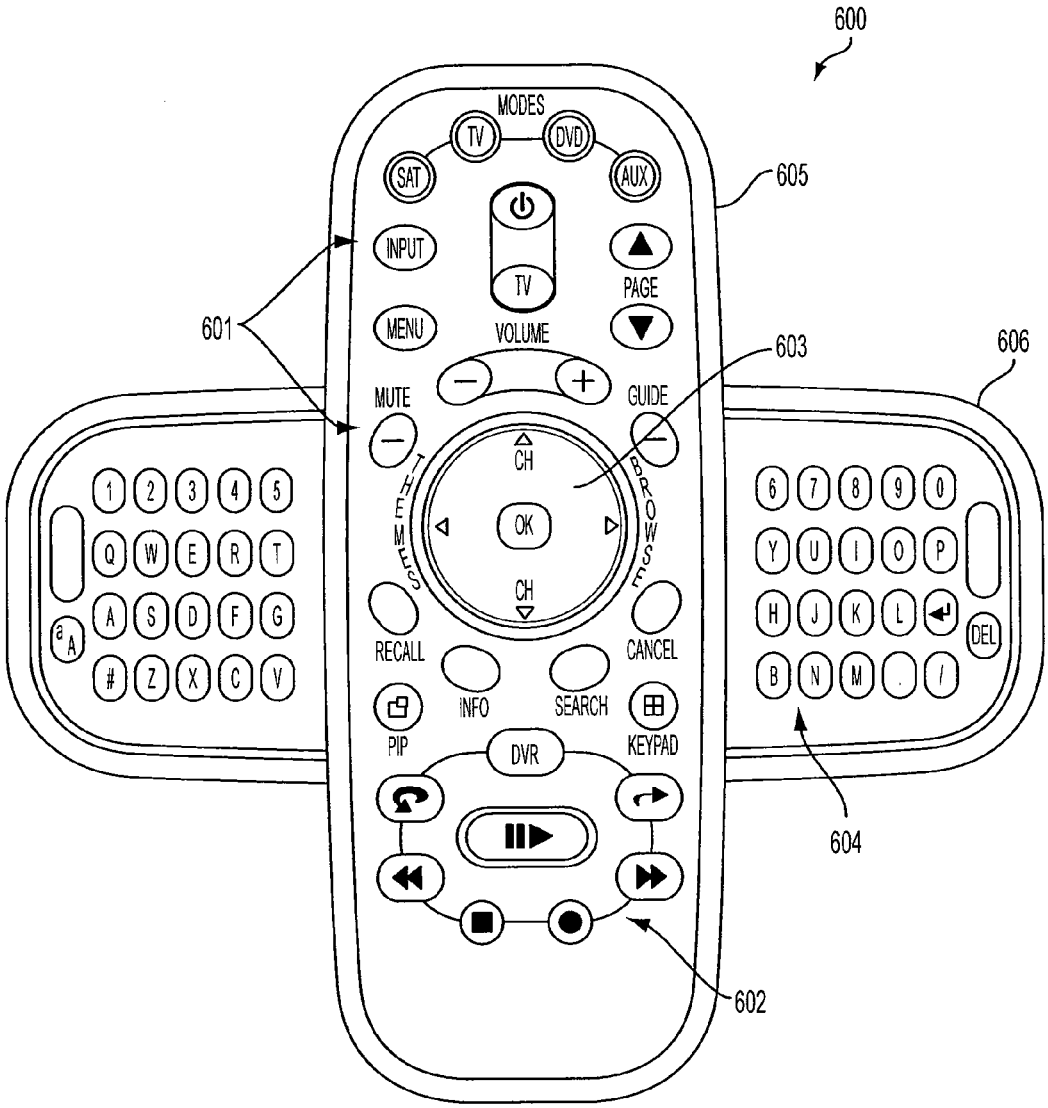

FIGS. 6A and 6B are top plan views illustrating a second example remote control device 600 that may be utilized in the system 100. As can be seen by comparison of FIGS. 6A and 6B with FIGS. 2A and 2B, the selection members 601, 602, and 603 of the remote control device 600 are arranged in a different configuration than the selection members 201, 202, and 203 of the remote control device 200. Similarly, as can be seen by comparison of FIG. 6B with FIG. 2B, the keyboard 604 of the remote control device 600 is arranged in a different configuration than the keyboard 204 of the remote control device 200.

Although the present disclosure has been described in the context of a remote control device, it is understood that other communication devices may take shapes illustrated and described in this disclosure, may have similar twisting relationship between two halves as the described and illustrated remote control device, and may have similar functionality to the described and illustrated remote control device. Such other communication devices may be devices such as phones, mobile computing devices, game controllers, and so on.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

Portions of the described disclosure may be provided as a computer program product, or software, that may include a machine-readable medium having stored thereon instructions, which may be used to program a computer system (or other electronic devices) to perform a process according to the present disclosure. A machine-readable medium includes any mechanism for storing information in a form (e.g., software, processing application) readable by a machine (e.g., a computer). The machine-readable medium may take the form of, but is not limited to, a: magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

The invention claimed is:

1. A remote control device, comprising:

a first portion, the first portion including a plurality of selection members associated with functionality of an entertainment device;

a second portion including a keyboard with a plurality of alphabet keys, the second portion rotatably connected to the first portion, the second portion operable to rotate with respect to the first portion between at least a first and second position wherein in the first position the first portion at least partially covers the keyboard of the second portion; and a control circuit configured to wirelessly control the entertainment device, to transmit a first position signal to the entertainment device in response to the second portion rotating to the first position, and to transmit a second position signal to the entertainment device in response to the second portion rotating to the second position, the first and second position signals respectively indicating that the second portion has rotated to the first or second position;

wherein the keyboard and the plurality of selection members share an orientation when the second portion is in the second position and wherein at least a first alphabet key of the plurality of alphabet keys is disposed to a first side of the first portion and at least a second alphabet key of the plurality of alphabet keys is disposed to a second side of the first portion when the second portion is in the second position, the control circuit configured to cause the entertainment device to display, on a display coupled to the entertainment device, symbols corresponding to the alphabet keys of the second portion pressed by a user.

2. The remote control device of claim 1, wherein the remote control is operable to provide an indication to a user in response to a signal received from the entertainment device.

3. The remote control device of claim 1, wherein each of the plurality of selection members are associated with a different functionality than each of the keys.

4. The remote control device of claim 1, wherein the plurality of selection members includes a navigation device.

5. The remote control device of claim 1, wherein the first portion includes a display.

6. A system comprising:

a television receiver, operable to transmit a display image to a display device; and a remote control device, operable to transmit control signals to the television receiver, the remote control comprising:

a first portion, the first portion including a plurality of selection members associated with functionality of the television receiver functionality; and a second portion, including a keyboard with a plurality of alphabet keys, rotatably connected to the first portion, the second portion operable to rotate with respect to the first portion between at least a first and second position wherein in the first position the first portion at least partially covers the keyboard of the second portion, the keyboard and the plurality of selection members share an orientation when the second portion is in the second position, and wherein at least a first alphabet key of the plurality of alphabet keys is disposed to a first side of the first portion and at least a second alphabet key of the plurality of keys is disposed to a second side of the first portion when the second portion is in the second position; and a control circuit configured to transmit control signals to the television receiver, to transmit a first position signal to the television receiver in response to the second portion rotating to the first position, and to transmit a second position signal to the television receiver in response to the second portion rotating to the second position, the first and second position signals respectively indicating that the second portion has rotated to the first or second position;

wherein the television receiver is operable to receive at least one control signal transmitted by the remote control device, to display, on a display coupled to the entertainment device, symbols corresponding to the alphabet keys of the second portion pressed by a user.

7. The system of claim 6, wherein the television receiver is operable to transmit an updated display image to the display device in response to receiving the first or the second position signal from the remote control device.

8. The system of claim 7, wherein the updated display image is generated at least partially based on a context of the display image.

9. The system of claim 8, wherein the updated display image is a first image when the context of the display image is a first context and the updated display image is a second image when the context of the display image is a second context.

10. The system of claim 7, wherein the updated display image includes a web browser interface.

11. The system of claim 7, wherein the display image includes a programming content menu navigable by scrolling, and the updated display image includes a programming content menu navigable by text searching.

12. The system of claim 6, wherein the remote control device is operable to provide an indicator to a user in response to receiving an indicator signal from the television receiver.

13. The system of claim 12, wherein the indicator comprises at least one of lighting at least one lighting element, playing a sound via a speaker of the remote control device, and displaying a remote display image on a display of the remote control device.

14. The system of claim 6, wherein at least one of plurality of selection members is associated with a first functionality when the second portion is in the first position and with a second functionality when the second portion is in the second position.

15. A method, comprising:

transmitting a first display image from an entertainment device to at least one display device;

receiving control signals from a remote control device;

executing instructions received in the control signals;

receiving a position signal at the entertainment device from the remote control device indicating that a first portion of the remote control has rotated to a first position with respect to a second portion of the remote control, the second portion including a plurality of selection members associated with entertainment device functionality, the first portion including a keyboard with a plurality of keys at least partially obscured in the second position by the second portion, a first end of the keyboard being disposed on a first side of the first portion and second end of the keyboard being disposed on a second side of the first portion when in the first position, the keyboard sharing an orientation with the plurality of selection members when the first portion is in the first position; and transmitting a second display image from the entertainment device to the at least one display device in response to receiving the position signal.

16. The method of claim 15, further comprising:

transmitting an indicator signal to the remote control device directing the remote control device to provide an indication to a user.

17. The method of claim 15, wherein the second display image that the entertainment device transmits to the at least one display device in response to the received signal is at least partially based on a context of the first display image.

18. The method of claim 15, further comprising:

associating a different functionality with at least one of the plurality of selection members when the first portion is rotated to the first position.

* * * * *